US007469561B2

(12) United States Patent
Krauss

(10) Patent No.: US 7,469,561 B2
(45) Date of Patent: Dec. 30, 2008

(54) NEEDLE BED WITH DISCONTINUOUS NEEDLE GUIDES

(75) Inventor: Rainer Krauss, Zell u.A. (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 11/907,196

(22) Filed: Oct. 10, 2007

(65) Prior Publication Data

US 2008/0184745 A1 Aug. 7, 2008

(30) Foreign Application Priority Data

Oct. 10, 2006 (EP) ..... 06021217

(51) Int. Cl.
*D04B 9/08* (2006.01)

(52) U.S. Cl. ..... 66/115

(58) Field of Classification Search ..... 66/64, 66/1 R, 114, 115

See application file for complete search history.

(56) References Cited

U.S. PATENT DOCUMENTS 541,406 A * 6/1895 Williams ..... 66/107
2,399,440 A * 4/1946 Koppel ..... 66/115
3,301,014 A * 1/1967 Wiesinger ..... 66/115
3,545,233 A * 12/1970 Lombardi ..... 66/8
3,817,058 A * 6/1974 Lombardi ..... 66/8
5,077,990 A * 1/1992 Plath ..... 66/123
5,398,526 A * 3/1995 Liu ..... 66/8
5,577,401 A * 11/1996 Pernick ..... 66/8
5,609,044 A * 3/1997 Tacy ..... 66/115

FOREIGN PATENT DOCUMENTS

EP 0 337 178 A2 3/1999
EP 1 256 645 A1 5/2001

* cited by examiner

*Primary Examiner*—Danny Worrell
(74) *Attorney, Agent, or Firm*—Norman N. Kunitz; Fitch, Even, Tabin & Flannery

(57) ABSTRACT

A needle bed (2) in accordance with the invention for a knitting machine comprises guide channels for knitting tools that are interrupted, in particular, in the region of the knitting lock, so that each needle is only guided laterally in the region of its foot. Preferably, the needle bed is designed in a segmented manner, in which case the segments adjoin each other at a joint that extends in a direction transverse to all the guide channels. In so doing, the separating joint is located between the lock paths (15, 16; 16, 17; 17, 18 and 18, 19). The guide strips of the individual base body sections (5, 6, 7), respectively, are arranged offset with respect to each other by one needle division. Preferably, the needle body sections (5, 6, 7) have essentially the same configuration and are non-detachably connected to each other.

11 Claims, 4 Drawing Sheets

NEEDLE BED WITH DISCONTINUOUS NEEDLE GUIDES

CROSS REFERENCE TO RELATED APPLICATION

This application claims the priority of European Patent Application No. 06 021 217.2, filed on Oct. 10, 2006, the subject matter of which, in its entirety, is incorporated herein by reference.

BACKGROUND OF THE INVENTION

The invention relates to a needle bed for a knitting machine, in particular for the installation of a needle set comprising needles having different foot positions.

Referring to document DE 35 32 856 C1, a circular knitting machine comprising a knitting cylinder has been known, said knitting cylinder comprising guide channels for needles and holding-down sinkers. In so doing, needles having different foot positions are provided. Accordingly, the associate needle lock comprises several lock paths which are at a distance from each other with respect to the longitudinal direction of the needle. The knitting cylinder has grooves, into which flat guide strips are set on end. These guide strips form the walls of the guide channels for the latch-type needles as well as for the holding-down sinkers. The knitting cylinder is divided into an upper part for the support of the holding-down sinkers and into a lower part for the support of the latch-type needles. The guide strips extend across the entire height of the lower part of the knitting cylinder and the knitting lock. Accordingly, a large area of the needles is in abutment with the guide strips. The guide strips are interrupted between the sinker lock and the knitting lock. However, two guide strips are provided for each pair of holding-down sinkers and needles or knitting needles.

Referring to high-speed knitting machines, the force required for driving the knitting needles plays an increasingly important part, considering the driving power.

It is the object of the invention to improve a needle bed in view of the power required for driving the needles.

SUMMARY OF THE INVENTION

This object is achieved with the needle bed in accordance with Claim 1.

The needle bed in accordance with the invention can be used as a knitting cylinder with needle channels that are parallel to each other, as a dial with radially arranged needle channels, or as a flat bed of a flat-bed knitting machine. In each case, this needle bed is characterized in that at least one of the channel walls of the needle channels has an interruption at a point opposite the needle lock. This interruption is preferably located opposite a lock cam, which means, the lock cam that does not drive the needle present in the respective needle channel. With respect to the longitudinal direction of the needle channel, the interruption preferably has a length that is at least twice the amplitude of the lock cam of another needle. Consequently, the cutout extends, for example, at least across the amplitude of at least one lock cam not belonging to the needle of the viewed guide channel. In so doing, the amplitude of the lock cam is understood to be the distance between the foot position when the other needle is driven out the farthest and the foot position when the other needle is retracted the farthest, said distances being measured in the direction of the guide channel.

Preferably, the arrangement is such that the channel walls provide lateral support only for those channel sections that actually require supporting. Those sections may be, for example, the sections of the needle that are provided with a needle foot. It is sufficient if the length of the channel walls measured in longitudinal direction of the needle is as long as the stroke of the needle. As a result of this measure, the footless sections of the needle body may move freely and without contacting the channel walls, thereby reducing the friction of the needle in its guide channel. As a result of this, the force required for driving the needle is reduced. The needle may be a machine knitting needle, which is configured, for example, as a compound needle, a latch-type needle, a rehanging needle, etc.

Furthermore, by using the measure in accordance with the invention, the wear of the needle in its guide channel may be reduced. Furthermore, free spaces that may contribute to cooling the needles may be created in the knitting cylinder.

The knitting cylinder in accordance with the invention may be loaded with conventional knitting needles. Custom designs of needles or knitting tools, as well as adaptations to the modified knitting cylinder, are not necessary.

The invention is particularly suitable for needle beds that are loaded with a needle set that comprises needles displaying different foot positions. In so doing, the foot positions of adjacent needles with respect to the longitudinal direction of the needles are offset relative to each other to such an extent that the moving ranges of the feet do not overlap. Preferably, the needle bed is divided along a line which is located between the ranges of movement of the feet of the needles displaying different foot positions. In so doing, the dividing line of adjacent base body sections of the needle bed are also located between adjacent lock cams of the needle lock. As a result, each needle body is supported by the channel walls only over a partial section of its foot portion. If the needle set comprises, for example, needles with three different foot positions and if, correspondingly, the needle lock comprises three lock cams, the foot section of the needle is laterally supported only in that region in which the lock cam associated with this needle is located.

The channel walls of a base body section preferably form a sequence which is offset—in longitudinal direction of the needle—by two or more foot distances (divisions) with respect to the sequence formed by the channel walls of the adjacent base body section. In addition, the channel walls of a base body section preferably form a sequence which—in a direction transverse to the longitudinal direction of the needle—is offset by two or more needle distances (divisions) with respect to the sequence formed by the channel walls of the adjacent base body section. Considering, in particular, annular needle beds, for example, knitting cylinders, various equally configured ring segments may be provided, said ring segments being rotated relative to each other by one or more divisions, attached to each other and connected to each other. This reduces manufacturing expenses without having to accept any losses of quality.

Preferably, the base body sections are rigidly connected to each other. The connection can be achieved by detachable connecting means such as screws or even by connecting means that cannot be removed in a non-destructive manner such as adhesive connections, welding connections or the like.

Preferably, the channel walls are formed by a guide strips (insets) that are set in corresponding slits. These guide strips may be made of a different material than the base body. Preferably, they are flat parts that are set into the pre-tooled slits of the base body and are non-detachably mounted therein. The attachment may be achieved by cementing, riveting, caulking, laser-welding, and the like.

Preferably, the guide strips are flush at their front ends with the base body sections. This permits a simple manufacture without having to accept any loss of quality.

Additional details of advantageous embodiments of the invention are the subject matter of the drawings, the description, as well as the claims.

The drawings show an exemplary embodiment in accordance with the inventions.

DETAILED DESCRIPTION OF THE INVENTION

Figure 1:
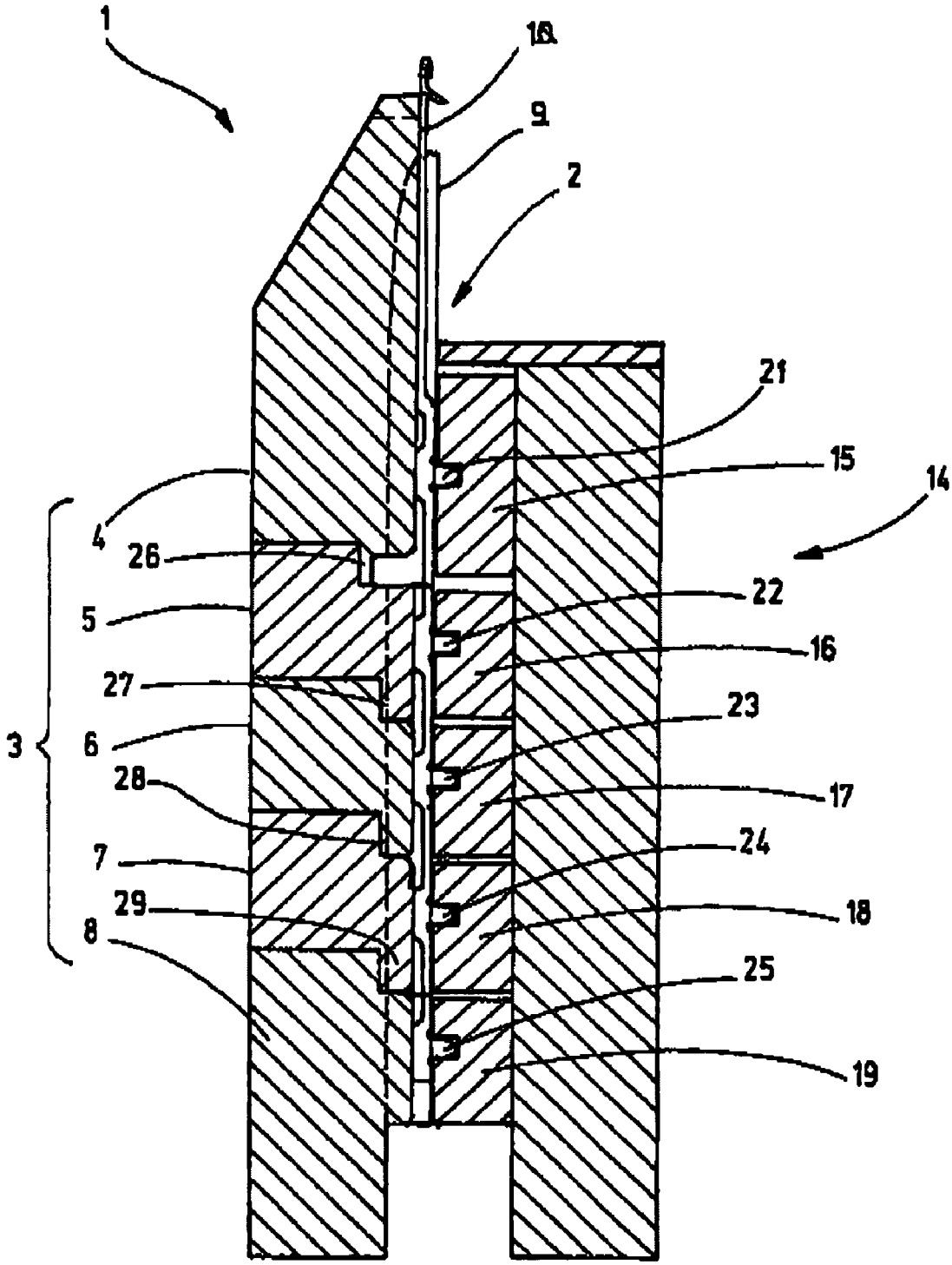
FIG. 1 is a schematic diagram of a detail, vertically in section, of a knitting cylinder with needles.

FIG. 1 shows a detail, vertically in section, of a knitting cylinder 1 of a circular knitting machine. The knitting cylinder 1 forms a needle bed 2. The latter is formed by a base body 3 which, in the present exemplary embodiment, consists of several annular base body sections 4, 5, 6, 7, 8 and of guide strips 9, 11. The guide strips 9, 11 are set in corresponding slits of the base body 3 and are oriented parallel to the axial direction of the knitting cylinder. Between them, they define guide channels in which the needles 10 are seated.

The knitting cylinder 1 is associated with a knitting lock 14 which comprises the lock paths 15, 16, 17, 18, 19 for the needles 10. Each of the needles 10 present in the knitting cylinder 1 has a needle body with a foot 21, 22, 23, 24, 25 provided thereon. In so doing, the needle set includes several groups of needles 10. A first group of needles has feet 21 that are in engagement with the first lock path 15. A second group of needles 10 has feet 22 that are in engagement with the lock path 16 underneath. A third group of needles has feet 23 that are in engagement with another lock path 17. A fourth group of needles 10 has feet 24 that are in engagement with another lock path 18. A fifth group of needles 10 has feet 24 that are in engagement with a lower lock path 19. The feet 21, 22, 23, 24, 25 of the groups of needless are thus axially at a distance from each other, whereby they are moved back and forth by the lock paths 15, 16, 17, 18, respectively, in longitudinal direction of the cylinder, by a distance that is shorter than the lock path 15, 16, 17, 18 or 19, measured in longitudinal direction of the needle.

The individual annular base body sections 4, 5, 6, 7, 8 of the knitting cylinder 1 are arranged in alignment with each other. To achieve this, alignment means 26, 27 28, 29 are provided, said means—in the present example (FIG. 1)—acting as centering means that are configured as appropriately arranged centering collars and centering cutouts.

Figure 3:
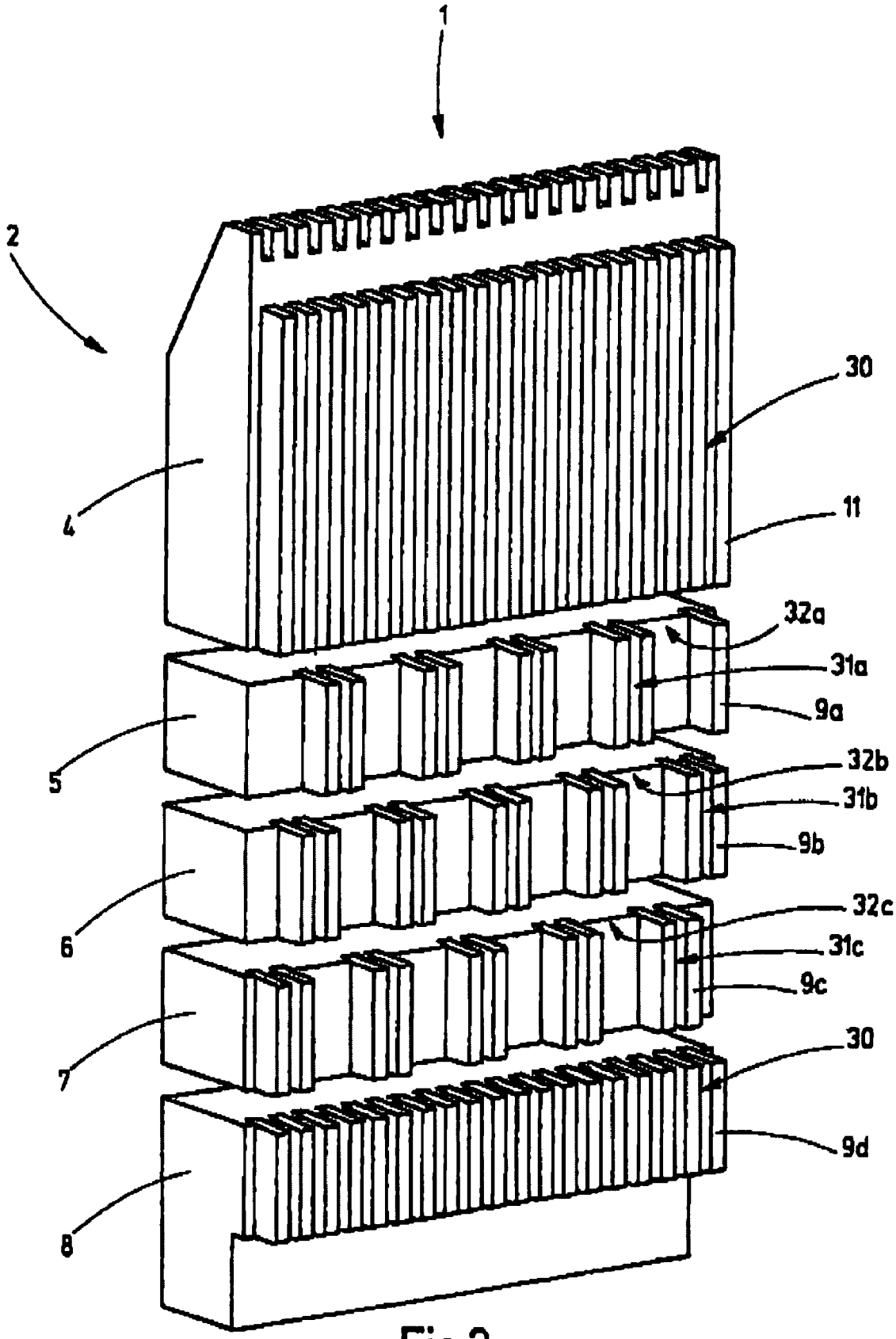
FIG. 3 is a perspective exploded view of a detail of the knitting cylinder in accordance with FIG. 1.
Figure 4:
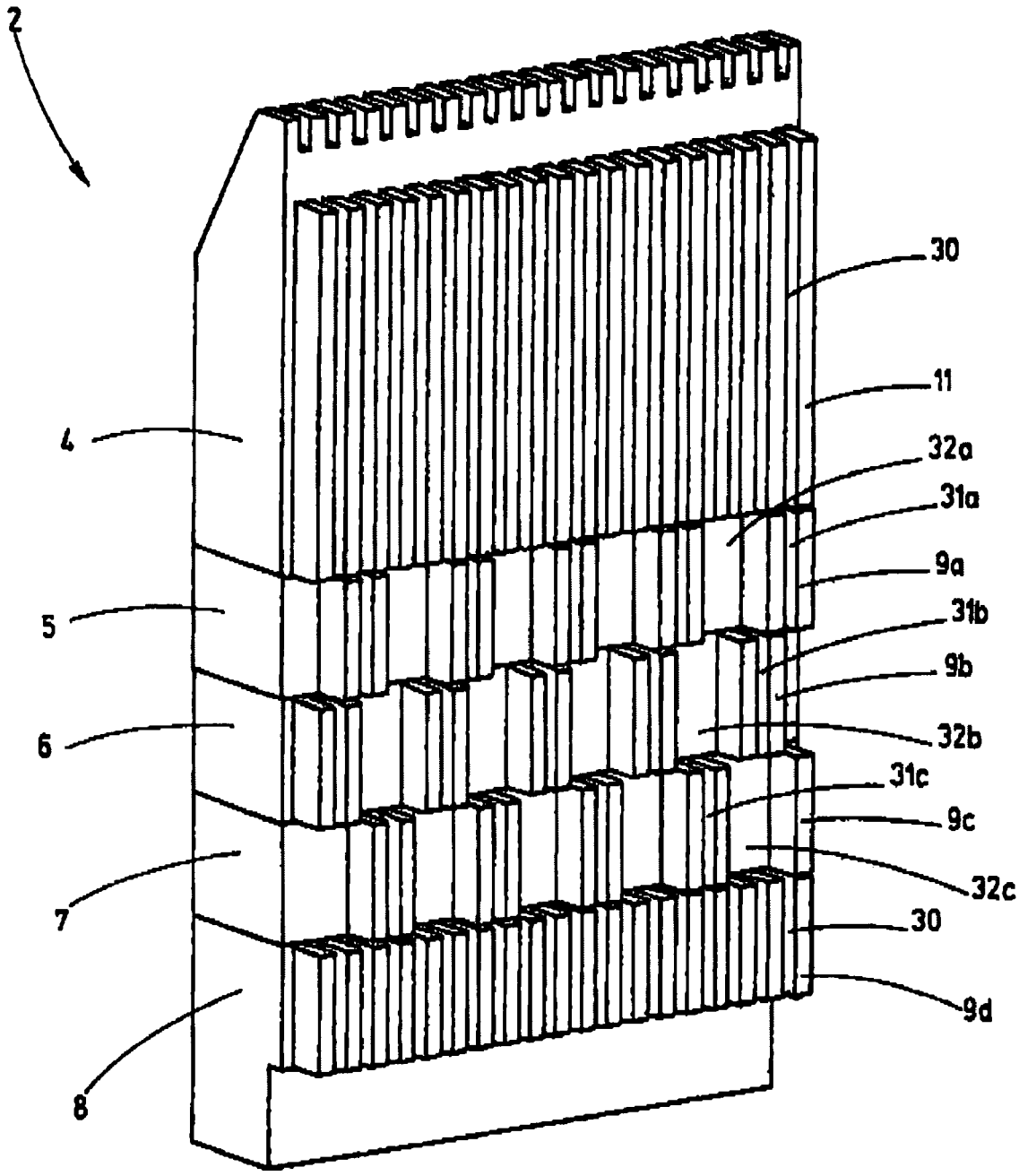
FIG. 4 is a perspective illustration of the detail in accordance with FIG. 3.

The special feature of the needle bed 2 or of the knitting cylinder 1 is obvious from FIGS. 3 and 4. The base body section 4 and the base body section 8, respectively, are provided with a number of slits which corresponds to the number of needles 10. Consequently, exactly one guide channel 30 is available for each needle. The base body sections 5, 6, 7 located in between have fewer slits and, correspondingly, fewer guide strips 9*a*, 9*b*, 9*c* than there are needles to be supported on the knitting cylinder 1. Each base body section 5, 6, 7, respectively, has guide strips 9*a*, 9*b*, 9*c*, these being arranged in pairs in order to define the guide channels 31*a*, 31*b*, 31*c*. The width of these guide channels 31*a*, 31*b*, 31*c* corresponds to the width of the guide channel 30. The guide channels 31*a*, 31*b*, 31*c* are disposed to support those sections of the needles 10 which bear the feet 21 and 25, respectively.

Between the pairs of guide strips 9*a* are gaps 32*a* (cutouts) which do not contain guide strips. Extending through these gaps, in an unguided manner, are the needles having the feet 23 and 24. Correspondingly, gaps 32*b* (cutouts) are provided between the pairs of guide strips 9*b* of the base body section 6. Extending through these gaps, in an unguided manner, are the needles having the feet 22 and 24.

Correspondingly, the base body section 7 has gaps 32*c* (cutouts) between the pairs of guide strips 9*c*, through which extend, in an unguided manner, the bodies of the needles having the feet 22, 23.

The cutouts or gaps 32*a*, 32*b*, 32*c* interrupt the lateral walls of the respective guide channel, respectively at least over the length of the lock paths 16, 17, 18, which length is to be measured parallel to the needles 10. In so doing, the cutouts are arranged for each guide path exactly where the lock paths are located that are not in engagement with the foot of the needle of the viewed guide channel.

Consequently, each needle is guided only on its hook-side shaft section and on its end remote from the hook, as well as on its foot-bearing section of its needle body. Other than that, the needle extends freely through the part of the needle bed located opposite the needle lock 14. This prevents friction of the needle, in particular any static friction and—taking into consideration the lubrication of the needle—sliding friction as well.

Considering the measure in accordance with the invention, the number of slits to be milled in the base body sections 5, 6, 7 is cut in half. This represents a manufacturing advantage.

At their end sides, the guide strips 9*a*, 9*b*, 9*c* preferably are flush with the base body sections 5, 6, 7. Consequently, they do not require any special alignment, this representing a manufacturing simplification. The strips 9*a*, 9*b*, 9*c*, 9*d*, 11 are preferably non-detachably connected to the respective base body section 4, 5, 6, 7, 8, for example, by cementing. Also, the base body sections 4, 5, 6, 7, 8 may be cemented to each other.

Figure 2:
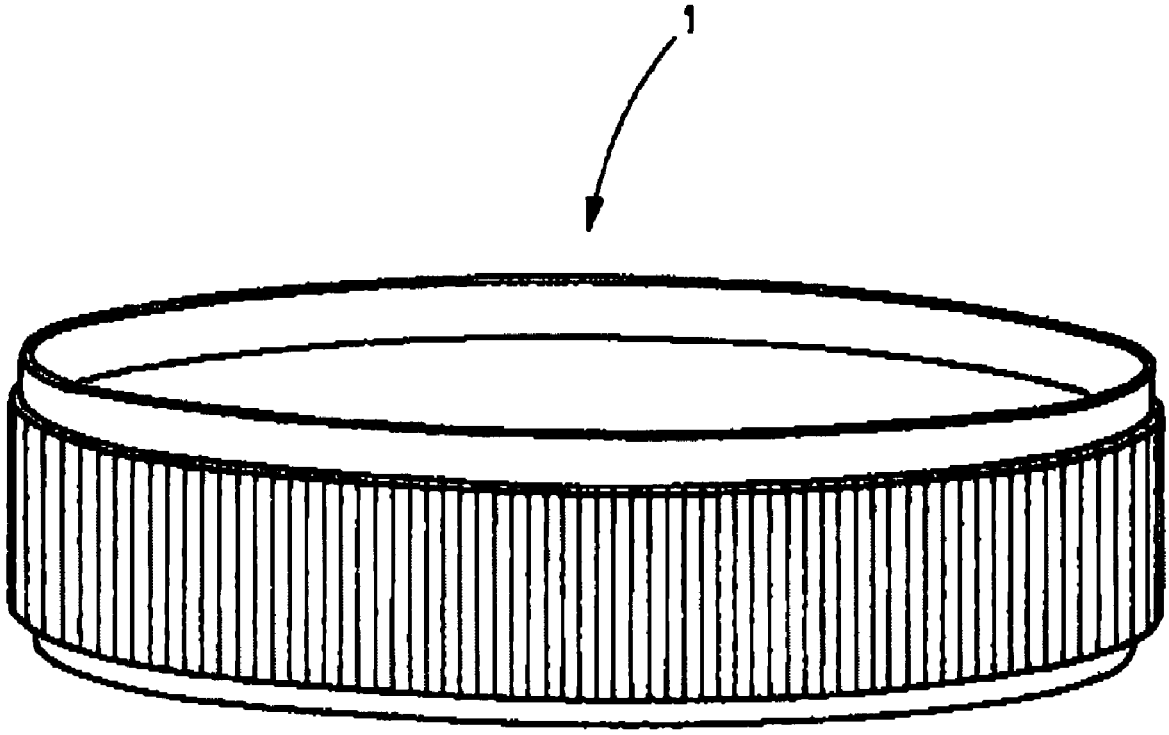
FIG. 2 is a schematic overview of the knitting cylinder in accordance with FIG. 1.

Referring to the present description, the needle bed 2 is understood to represent the knitting cylinder 1, as it is shown separately in FIG. 2. However, the description applies to a needle bed that is configured as a dial with the single difference that the adjacent guide channels are not oriented in axial direction as illustrated in FIGS. 3 and 4, and thus, together, subtend an acute angle.

The needle bed 2 described so far may also be configured as a flat bed, in which case the present description applies, again with respect to FIGS. 1, 3 and 4. In that case, the base body sections 4, 5, 6, 7, 8 are not annular but have the configuration of a bar or a rod.

A needle bed 2 in accordance with the invention for a knitting machine comprises guide channels for knitting tools that are interrupted, in particular, in the region of the knitting lock, so that each needle is only guided laterally in the region of its foot. Preferably, the needle bed is designed in a segmented manner, in which case the segments adjoin each other at a joint that extends in a direction transverse to all the guide channels. In so doing, the separating joint is located between the lock paths 15, 16; 16, 17; 17, 18 and 18, 19. The guide strips of the individual base body sections 5, 6, 7, respectively, are arranged offset with respect to each other by one needle division. Preferably, the needle body sections 5, 6, 7 have essentially the same configuration and are non-detachably connected to each other.

It will be appreciated that the above description of the present invention is susceptible to various modifications, changes and adaptations, and the same are intended to be comprehended within the meaning and range of equivalents of the appended claims.

LIST OF REFERENCE NUMBERS

1 Knitting cylinder
2 Needle bed
3 Base body
4 Base body section
5 Base body section
6 Base body section
7 Base body section
8 Base body section
9 Guide strips 9*a*-9*d*
10 Needles
11 Guide strips
14 Knitting lock
15 Lock path
16 Lock path
17 Lock path
18 Lock path
19 Lock path
20
21 Foot
22 Foot
23 Foot
24 Foot
25 Foot
26 Alignment means
27 Alignment means
28 Alignment means
29 Alignment means
30 Guide channel
31 Guide channel
32 Cutouts, gaps

The invention claimed is:

1. Needle bed for a knitting machine, comprising a base body that is provided with a number of guide channels which are configured for the accommodation and longitudinally shiftable support of knitting tools, respectively, between two guide strips, wherein: at least one of the guide strips has an interruption alone its length at a location opposite a needle lock; the needle bed comprises a base body which is divided into at least two base body sections extending in a direction transverse to the longitudinal direction; and guide strips associated with one of the base body sections form a lateral sequence due to the respective interruptions that is offset with respect to a lateral sequence that is formed by the guide strips of another base body section due to its respective interruptions.

2. Needle bed in accordance with claim 1, wherein the base body has the shape of a ring, and the needle bed is a knitting cylinder or a dial.

3. Needle bed in accordance with claim 1, wherein the needle bed is an elongate straight needle bed of a flat-bed knitting machine.

4. Needle bed in accordance with claim 1, wherein the needle bed comprises a base body in which slits are provided, in which insets are held, said insets forming the guide strips.

5. Needle bed, for a knitting machine, comprising a base body that is provided with a number of guide channels which are configured for the accommodation and longitudinally shiftable support of knitting tools, respectively, between two guide strips, wherein: at least one of the guide strips has an interruption along its length at a location opposite a needle lock; the needle bed comprises a base body that is divided into at least two base body sections extending in a direction transverse to the longitudinal direction; and has the shape of a ring; the needle bed is a knitting cylinder or a dial; and, at least two adjacent base body sections are offset with respect to each other in the circumferential direction by the distance of a needle or by the distances of several needles.

6. Needle bed in accordance with claim 1, wherein the base body sections adjoin each other at a separating joint that is provided between two lock paths.

7. Needle bed in accordance with claim 1, wherein the base body sections are rigidly connected to each other.

8. Needle bed in accordance with claim 1, wherein at least two of the base body sections are provided with guide strips that are configured in the same manner with respect to each other.

9. Needle bed in accordance with claim 8, wherein front ends of the guide strips are flush with the base body sections.

10. Needle bed in accordance with claim 1, wherein the base body sections are provided with guide strips, the number of said guide strips being smaller than the number of needles to be supported on the knitting cylinder.

11. Needle bed in accordance with claim 5 wherein the at least two adjacent base body sections are provided with guide strips and guide strip interruptions that are configured in the same manner with respect to each other.

* * * * *